US007535451B2

(12) United States Patent
Nohtomi et al.

(10) Patent No.: US 7,535,451 B2
(45) Date of Patent: May 19, 2009

(54) LIQUID CRYSTAL DRIVE METHOD, LIQUID CRYSTAL DISPLAY SYSTEM, AND LIQUID CRYSTAL DRIVE CONTROL DEVICE IN WHICH ONE SPECIFIED BIT IS CHANGED AT A SWITCH BETWEEN A POSITIVE PHASE AND A NEGATIVE PHASE

(75) Inventors: Shinobu Nohtomi, Tokyo (JP); Shigeru Ota, Koganei (JP); Shinya Suzuki, Kodaira (JP); Yoshitaka Iwasaki, Tachikawa (JP); Masahito Fujihira, Mobara (JP)

(73) Assignee: Renesas Technology Corp., Tokyo (JP)

( * ) Notice: Subject to any disclaimer, the term of this patent is extended or adjusted under 35 U.S.C. 154(b) by 453 days.

(21) Appl. No.: 10/822,730

(22) Filed: Apr. 13, 2004

(65) Prior Publication Data

US 2005/0001798 A1 Jan. 6, 2005

(30) Foreign Application Priority Data

Jun. 5, 2003 (JP) ..... 2003-160538

(51) Int. Cl.
*G09G 3/36* (2006.01)

(52) U.S. Cl. ..... 345/98; 345/95

(58) Field of Classification Search ..... 345/98, 345/96, 95, 92, 90, 89, 87, 55, 204, 215, 345/690

See application file for complete search history.

(56) References Cited

U.S. PATENT DOCUMENTS

| | | | | |
|---|---|---|---|---|
| 5,414,443 | A * | 5/1995 | Kanatani et al. | 345/95 |
| 5,905,504 | A * | 5/1999 | Barkans et al. | 345/597 |
| 5,905,769 | A * | 5/1999 | Lee et al. | 375/376 |
| 6,611,247 | B1 * | 8/2003 | Chang et al. | 345/99 |
| 7,006,114 | B2 * | 2/2006 | Sakaguchi | 345/690 |
| 2004/0104874 | A1 * | 6/2004 | Monomohshi | 345/87 |
| 2004/0123004 | A1 * | 6/2004 | Boudon et al. | 710/100 |
| 2005/0219191 | A1 * | 10/2005 | Pappalardo et al. | 345/98 |

* cited by examiner

*Primary Examiner*—Chanh Nguyen
*Assistant Examiner*—Pegeman Karimi
(74) *Attorney, Agent, or Firm*—Miles & Stockbridge P.C.

(57) ABSTRACT

There are provided a liquid crystal drive method, a liquid crystal display system and a liquid crystal drive control device, which can realize low power consumption at an alternating current drive of a liquid crystal panel. A common voltage given to a common electrode of a liquid crystal is switched between a positive phase and a negative phase. Display data is converted in such a manner that first display data and second display data selecting two of a plurality of gradation voltages in which magnitudes of potential differences in the pixel electrodes in the positive phase and the negative phase with reference to the common voltage corresponding to display data in a display memory are the same are in the same bit pattern except for one specified bit. For example, bit allocation of positive and negative gradation display data is made in such a manner that low-order bits other than the highest order bit are symmetric up and down in binary with respect to the middle.

9 Claims, 12 Drawing Sheets

FIG. 6

| GRADATION | DISPLAY DATA IN DISPLAY MEMORY | POSITIVE PHASE | | NEGAITIVE PHASE | |
|---|---|---|---|---|---|
| | | DATA BIT | SELECTIVE LEVEL | DATA BIT | SELECTIVE LEVEL |
| GRADATION 0 | 11111 | 11111 | V0 | 01111 | V31 |
| GRADATION 1 | 11110 | 11110 | V1 | 01110 | V30 |
| GRADATION 2 | 11101 | 11101 | V2 | 01101 | V29 |
| GRADATION 3 | 11100 | 11100 | V3 | 01100 | V28 |
| GRADATION 4 | 11011 | 11011 | V4 | 01011 | V27 |
| GRADATION 5 | 11010 | 11010 | V5 | 01010 | V26 |
| GRADATION 6 | 11001 | 11001 | V6 | 01001 | V25 |
| GRADATION 7 | 11000 | 11000 | V7 | 01000 | V24 |
| GRADATION 8 | 10111 | 10111 | V8 | 00111 | V23 |
| GRADATION 9 | 10110 | 10110 | V9 | 00110 | V22 |
| GRADATION 10 | 10101 | 10101 | V10 | 00101 | V21 |
| GRADATION 11 | 10100 | 10100 | V11 | 00100 | V20 |
| GRADATION 12 | 10011 | 10011 | V12 | 00011 | V19 |
| GRADATION 13 | 10010 | 10010 | V13 | 00010 | V18 |
| GRADATION 14 | 10001 | 10001 | V14 | 00001 | V17 |
| GRADATION 15 | 10000 | 10000 | V15 | 00000 | V16 |
| GRADATION 16 | 01111 | 00000 | V16 | 10000 | V15 |
| GRADATION 17 | 01110 | 00001 | V17 | 10001 | V14 |
| GRADATION 18 | 01101 | 00010 | V18 | 10010 | V13 |
| GRADATION 19 | 01100 | 00011 | V19 | 10011 | V12 |
| GRADATION 20 | 01011 | 00100 | V20 | 10100 | V11 |
| GRADATION 21 | 01010 | 00101 | V21 | 10101 | V10 |
| GRADATION 22 | 01001 | 00110 | V22 | 10110 | V9 |
| GRADATION 23 | 01000 | 00111 | V23 | 10111 | V8 |
| GRADATION 24 | 00111 | 01000 | V24 | 11000 | V7 |
| GRADATION 25 | 00110 | 01001 | V25 | 11001 | V6 |
| GRADATION 26 | 00101 | 01010 | V26 | 11010 | V5 |
| GRADATION 27 | 00100 | 01011 | V27 | 11011 | V4 |
| GRADATION 28 | 00011 | 01100 | V28 | 11100 | V3 |
| GRADATION 29 | 00010 | 01101 | V29 | 11101 | V2 |
| GRADATION 30 | 00001 | 01110 | V30 | 11110 | V1 |
| GRADATION 31 | 00000 | 01111 | V31 | 11111 | V0 |

FIG. 12 POSITIVE PHASE: SELECTIVE LEVEL [V11]
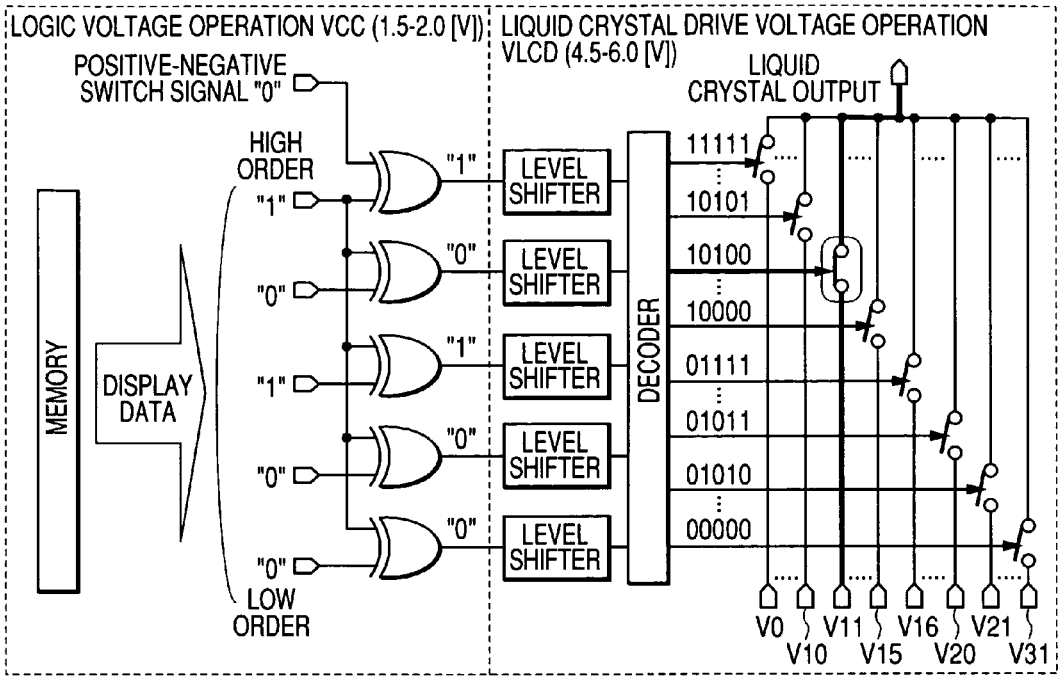
FIG. 13 NEGATIVE PHASE: SELECTIVE LEVEL [V20]
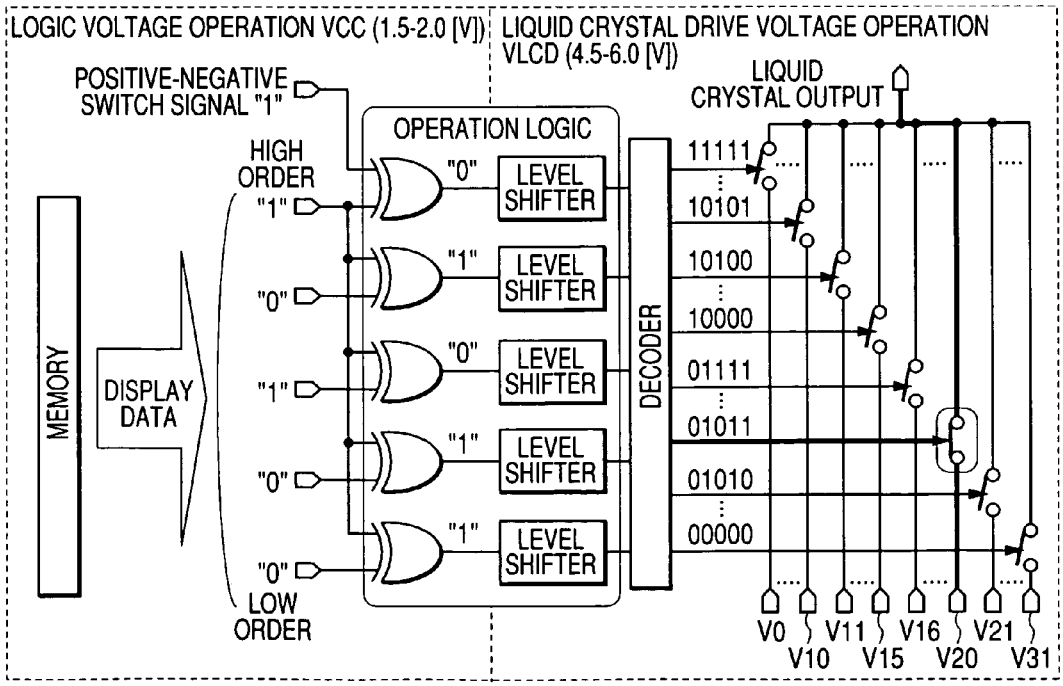

FIG. 14

| GRADATION | DISPLAY DATA IN DISPLAY MEMORY | POSITIVE PHASE | | NEGAITIVE PHASE | |
|---|---|---|---|---|---|
| | | DATA BIT | SELECTIVE LEVEL | DATA BIT | SELECTIVE LEVEL |
| GRADATION 0 | 11111 | 11111 | V0 | 00000 | V31 |
| GRADATION 1 | 11110 | 11110 | V1 | 00001 | V30 |
| GRADATION 2 | 11101 | 11101 | V2 | 00010 | V29 |
| GRADATION 3 | 11100 | 11100 | V3 | 00011 | V28 |
| GRADATION 4 | 11011 | 11011 | V4 | 00100 | V27 |
| GRADATION 5 | 11010 | 11010 | V5 | 00101 | V26 |
| GRADATION 6 | 11001 | 11001 | V6 | 00110 | V25 |
| GRADATION 7 | 11000 | 11000 | V7 | 00111 | V24 |
| GRADATION 8 | 10111 | 10111 | V8 | 01000 | V23 |
| GRADATION 9 | 10110 | 10110 | V9 | 01001 | V22 |
| GRADATION 10 | 10101 | 10101 | V10 | 01010 | V21 |
| GRADATION 11 | 10100 | 10100 | V11 | 01011 | V20 |
| GRADATION 12 | 10011 | 10011 | V12 | 01100 | V19 |
| GRADATION 13 | 10010 | 10010 | V13 | 01101 | V18 |
| GRADATION 14 | 10001 | 10001 | V14 | 01110 | V17 |
| GRADATION 15 | 10000 | 10000 | V15 | 01111 | V16 |
| GRADATION 16 | 01111 | 01111 | V16 | 10000 | V15 |
| GRADATION 17 | 01110 | 01110 | V17 | 10001 | V14 |
| GRADATION 18 | 01101 | 01101 | V18 | 10010 | V13 |
| GRADATION 19 | 01100 | 01100 | V19 | 10011 | V12 |
| GRADATION 20 | 01011 | 01011 | V20 | 10100 | V11 |
| GRADATION 21 | 01010 | 01010 | V21 | 10101 | V10 |
| GRADATION 22 | 01001 | 01001 | V22 | 10110 | V9 |
| GRADATION 23 | 01000 | 01000 | V23 | 10111 | V8 |
| GRADATION 24 | 00111 | 00111 | V24 | 11000 | V7 |
| GRADATION 25 | 00110 | 00110 | V25 | 11001 | V6 |
| GRADATION 26 | 00101 | 00101 | V26 | 11010 | V5 |
| GRADATION 27 | 00100 | 00100 | V27 | 11011 | V4 |
| GRADATION 28 | 00011 | 00011 | V28 | 11100 | V3 |
| GRADATION 29 | 00010 | 00010 | V29 | 11101 | V2 |
| GRADATION 30 | 00001 | 00001 | V30 | 11110 | V1 |
| GRADATION 31 | 00000 | 00000 | V31 | 11111 | V0 |

LIQUID CRYSTAL DRIVE METHOD, LIQUID CRYSTAL DISPLAY SYSTEM, AND LIQUID CRYSTAL DRIVE CONTROL DEVICE IN WHICH ONE SPECIFIED BIT IS CHANGED AT A SWITCH BETWEEN A POSITIVE PHASE AND A NEGATIVE PHASE

CROSS-REFERENCE TO RELATED APPLICATION

The present application claims priority from Japanese patent application JP 2003-160538 filed on Jun. 5, 2003, the content of which is hereby incorporated by reference into this application.

BACKGROUND OF THE INVENTION

The present invention relates to a liquid crystal drive method, a liquid crystal display system and a liquid crystal drive control device. The present invention relates mainly to a technique effective to be used for performing gradation display using a TFT (thin film transistor) liquid crystal display panel.

As a liquid crystal drive voltage switch method for the alternating current drive of a liquid crystal panel, the present inventors have studied a dynamic switch method and a control bit switch method prior to the present invention. FIG. 11 shows state changes at positive-negative switch in the dynamic switch method. In the dynamic switch method, display data set to each terminal cannot be changed due to positive-negative switch. A gradation generation circuit part for supplying a voltage to signal lines of a liquid crystal display panel is switched to a positive-negative level. Since display data cannot be changed due to positive-negative switch, the same selector switch is brought to the on state. In the negative phase, as indicated by the dotted lines in the drawing, voltages are switched so as to be symmetric up and down with respect to the midpoint voltage.

FIGS. 12 and 13 show state changes at positive-negative switch in the control bit switch method. In the control bit switch method, data set to each terminal is switched corresponding to positive and negative gradation voltage for the positive and negative phases. Display data having the highest order potential in the positive phase is switched to have the lowest order potential in the negative phase. An exclusive logic circuit outputs the display data as it is as logic 0 in the positive phase by a positive-negative switch signal, and inverts all or most bits of the display data as logic 1 in the negative phase. FIG. 14 shows data and selective levels of 32 gradations of 0 to 31 corresponding to the control bit switch method.

SUMMARY OF THE INVENTION

In the dynamic switch method, since all outputs of an amplifier generating a liquid crystal voltage are switched without fail, an electric current is consumed. In addition, one switch MOSFET changes voltages of the selected signal lines up and down by positive-negative switch. The output impedance of the selector switch MOSFET must be lowered corresponding to all the gradation voltages. The size of the MOSFET is formed to be large in consideration of the worst case, thereby increasing the chip area. In the control bit switch method, gradation voltages in a positive phase and a negative phase exist for each of adjacent scanning lines. Basically, display data of adjacent pixels is never or hardly changed so that its hamming distance is small. All or most control signals are changed for each positive-negative switch. The level shifter circuits boosting a logic control voltage to a display control voltage are operated to increase the current consumption.

An object of the present invention is to provide a liquid crystal drive method, a liquid crystal display system and a liquid crystal drive control device, which can realize low power consumption at an alternating current drive of a liquid crystal panel. The above and other objects and novel features of the present invention will be apparent from the description of this specification and the accompanying drawings.

The representative inventions disclosed in the present invention will be briefly described as follows. A common voltage given to a common electrode of a liquid crystal is switched between a positive phase and a negative phase. Display data in display memory is converted in such a manner that first display data and second display data selecting two of a plurality of gradation voltages which are the same in the positive phase and the negative phase with reference to the common voltage corresponding to the display data in the display memory of FIG. 6 are in the same bit pattern except for one specified bit.

The hamming distance between the first display data and the second display data is 1. For example, in display data conversion, bit allocation of positive and negative gradation display data is made in such a manner that low-order bits other than the highest order bit are symmetric up and down in binary with respect to the middle. A bit conversion circuit for performing the display data conversion is provided in a liquid crystal drive control device. The circuit inverts all or most bits for each switch between positive the phase and the negative phase. All or most logics and level shifter circuits shifting the voltage level from a logic voltage to a liquid crystal voltage are operated.

In the present invention, as shown in FIG. 6, only one specified bit is changed at switch between the positive phase and the negative phase corresponding to display data in a display memory. The number of logics constructing decoders operated and level shifter circuits shifting the voltage level from a logic voltage to a liquid crystal voltage is about 1/gradation bits (1 divided by gradation bits) as compared with the prior art.

BRIEF DESCRIPTION OF THE DRAWINGS

FIG. 6 is a gradation display data relation diagram showing a conversion example of an embodiment of display data according to the present invention;

FIG. 12 is an alternating current drive explanatory view of a liquid crystal voltage in the positive phase by a control bit switch method which has been studied prior to the present invention;

FIG. 13 is an alternating current drive explanatory view of a liquid crystal voltage in the negative phase by the control bit switch method which has been studied prior to the present invention;

FIG. 14 is a gradation display data relation diagram by the control bit switch method which has been studied prior to the present invention;

DESCRIPTION OF THE PREFERRED EMBODIMENTS

Figure 1:
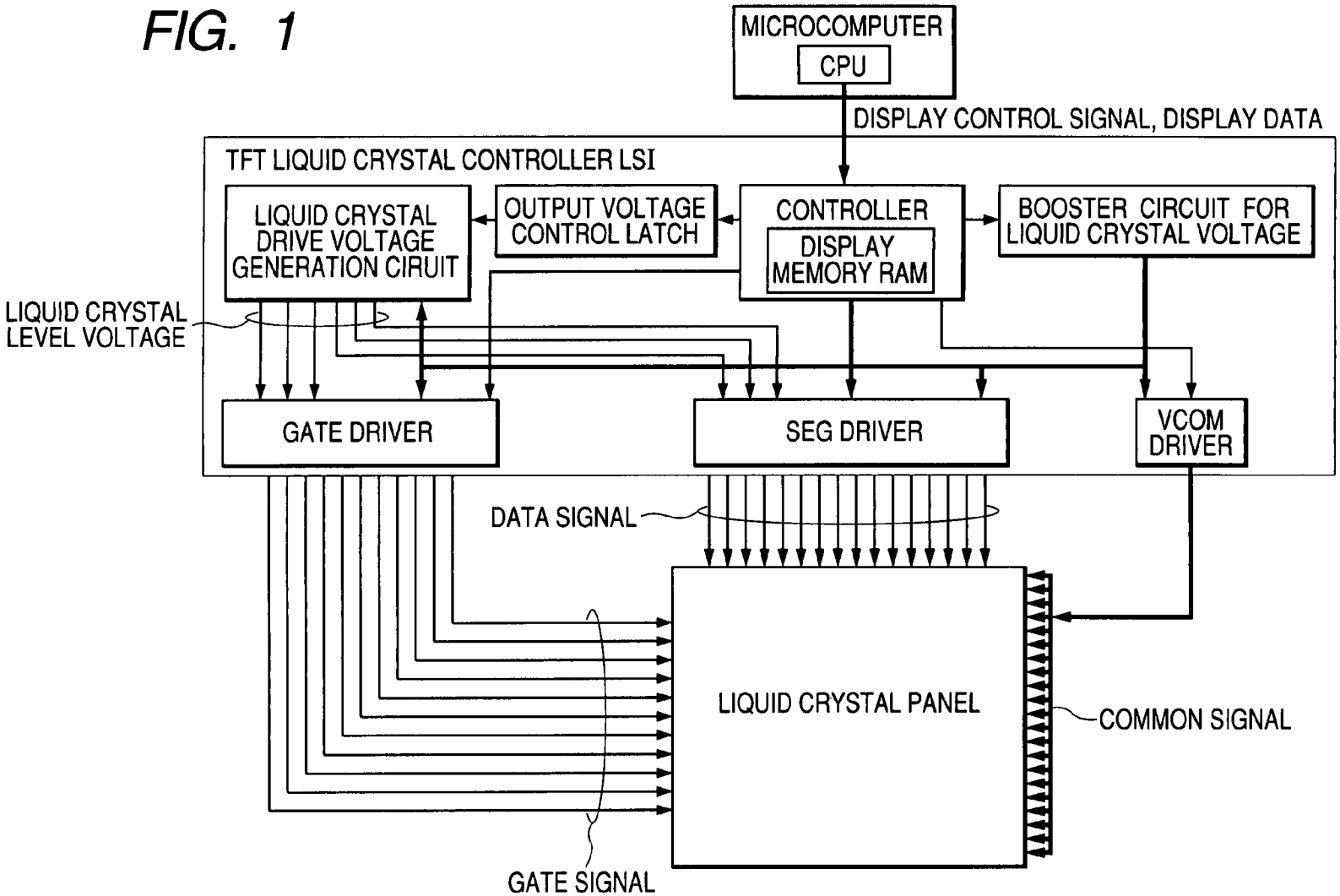
FIG. 1 is a block diagram of the main part of an embodiment of a liquid crystal display device according to the present invention.

FIG. 1 shows a block diagram of the main part of an embodiment of a liquid crystal display device and a liquid crystal display system according to the present invention. Not being particularly limited, a TFT liquid crystal controller LSI (hereinafter, also called a liquid crystal driver and an LCD driver) according to the present invention is manufactured over one semiconductor substrate using the known CMOS technique. The liquid crystal display device of this embodiment has a TFT liquid crystal controller LSI receiving a display control signal including display data generated by a microcomputer (microprocessing unit such as a microprocessor), not shown, and a liquid crystal panel.

Not being particularly limited, the TFT liquid crystal controller LSI is constructed by one semiconductor integrated circuit device and has a liquid crystal drive voltage generation circuit for supplying a voltage (gradation voltage) used for driving the liquid crystal panel; and as drivers for driving the liquid crystal panel based on the liquid crystal drive voltage, a SEG (segment) driver supplying a gradation voltage (data signal) to a signal line of the liquid crystal panel, a VCOM driver supplying a common voltage to a common electrode opposite the pixel electrode, and a GATE (gate) driver supplying a gate signal to a scanning line coupled to the gate of the TFT transistor of the liquid crystal panel. The signal line is coupled via the TFT transistor to the pixel electrode.

The TFT liquid crystal controller LSI has a controller for controlling the respective operations of the SEG (segment) driver, VCOM driver, GATE (gate) driver and liquid crystal drive voltage generation circuit, an output voltage control latch, and a booster circuit for liquid crystal voltage boosting a low operation voltage of the controller to supply the boosted high voltage to the respective drivers. The controller of the liquid crystal controller LSI has a display memory RAM as an incorporated memory storing display data.

Software executed by a central processing unit (CPU) in the microcomputer writes display data to be displayed on the liquid crystal panel to the display memory RAM in the liquid crystal controller. The display data written to the display memory RAM by the CPU has R (red) data, G (green) data and B (blue) data to each pixel when the liquid crystal panel is intended for color display. Not being particularly limited, each of the R, G and B data is expressed as gradation data of 5 bits. Not being particularly limited, the value of each of the gradation data is defined to be incremented by 1 in binary from the lowest gradation (gradation 0) 00000 to the highest gradation (gradation 31) 11111.

Bit order to allocation of gradation data are regarded to be defined by software executed by the CPU. Software executed by the CPU can be changed, bit order to allocation of gradation data can be changed by the software, and the gradation voltage selection operation at the change from the positive to negative phase or the change from the negative to positive phase at alternating current drive can be performed by a low power consumption.

To perform these, the change of the existing software resources, development of new software and the change of the data form of the entire liquid crystal display system are necessary. The system development period can be longer, and the system development cost can be increased. In a technique whose product cycle is short, the longer system development period and the increased system development cost are considered to be a critical loss.

In the case of system change so as to use the existing liquid crystal display system, software and data form as they are and to replace only the liquid crystal controller, the liquid crystal display system can impose a compatible problem. When changing gradation data allocation by the software, the gradation voltage selection operation at the change from the positive phase to the negative phase or the change from the negative phase to the positive phase at alternating current drive may be performed by a low power consumption. In the liquid crystal display system using the existing liquid crystal controller LSI, the gradation data allocation is changed. A color to be displayed cannot be displayed in the color intended for the liquid crystal panel.

Figure 4:
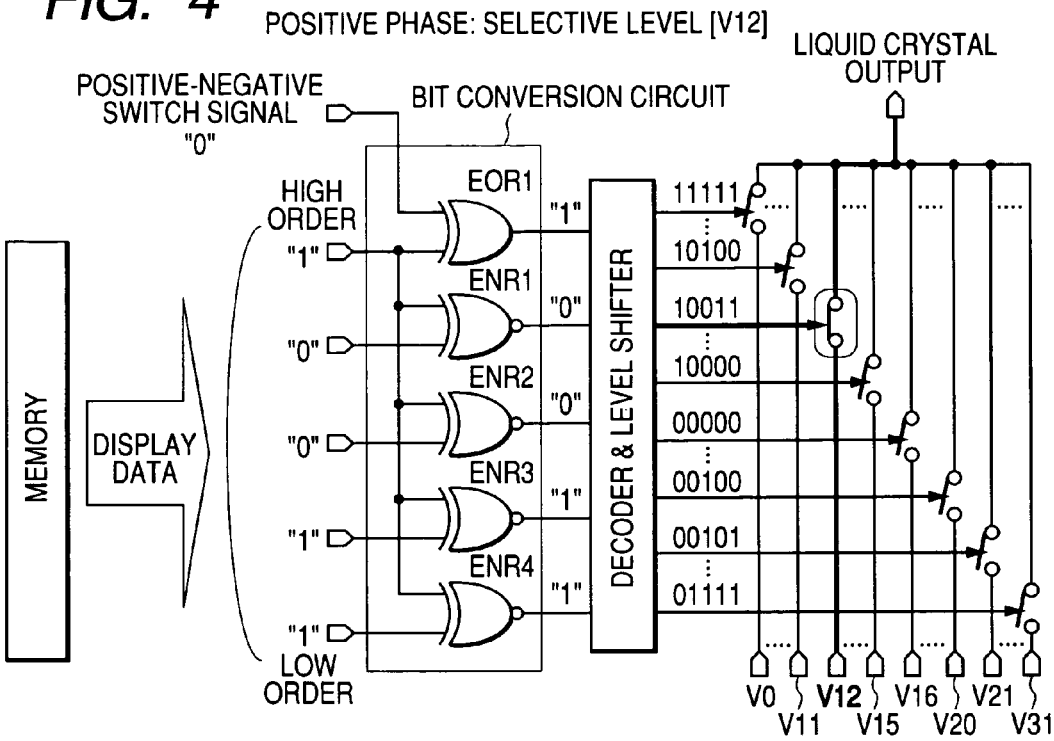
FIG. 4 is a schematic circuit diagram showing an embodiment of the SEG driver according to the present invention corresponding to the positive phase.
Figure 5:
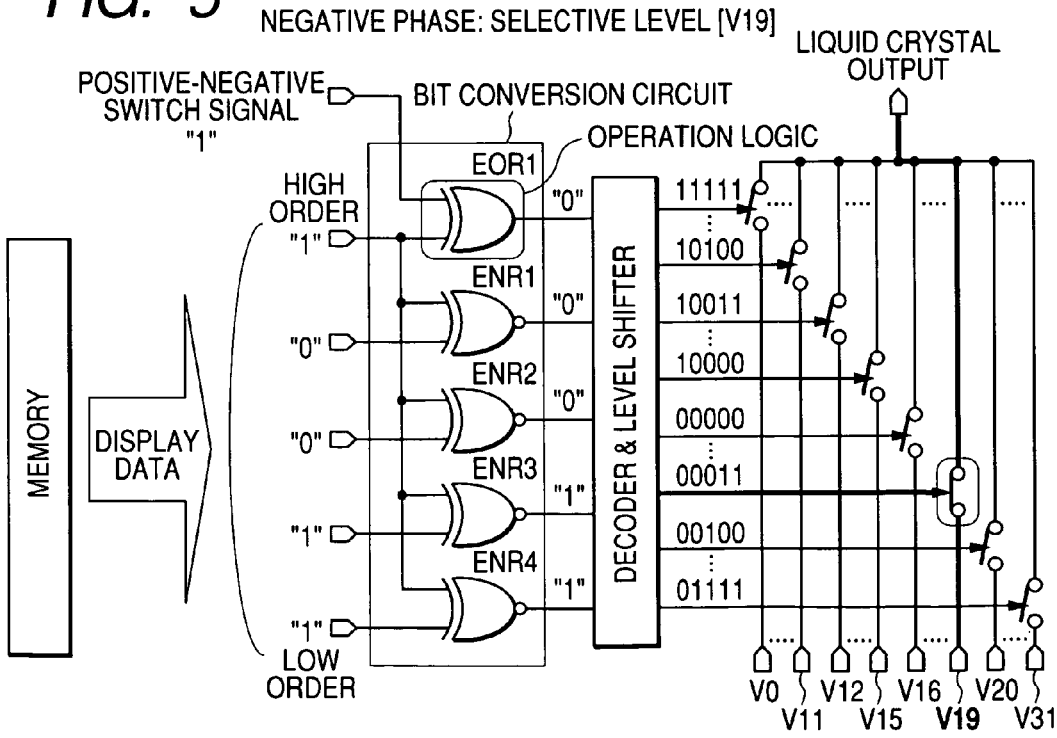
FIG. 5 is a schematic circuit diagram showing an embodiment of the SEG driver according to the present invention corresponding to the negative phase.

Without changing the software of the CPU, in other words, in order that a color to be displayed can be displayed in the color intended for the liquid crystal panel, the gradation data allocation is the same as the prior art to maintain compatibility. The gradation voltage selection operation at the change from the positive phase to the negative phase or the change from the negative phase to the positive phase at alternating current drive can be performed by a low power consumption. To perform these, in the present invention, a bit conversion circuit as shown in FIGS. 4 and 5 for performing bit order conversion of gradation data outputted from the display memory RAM is provided between the output of the display memory RAM and the gradation selector.

Figure 2:
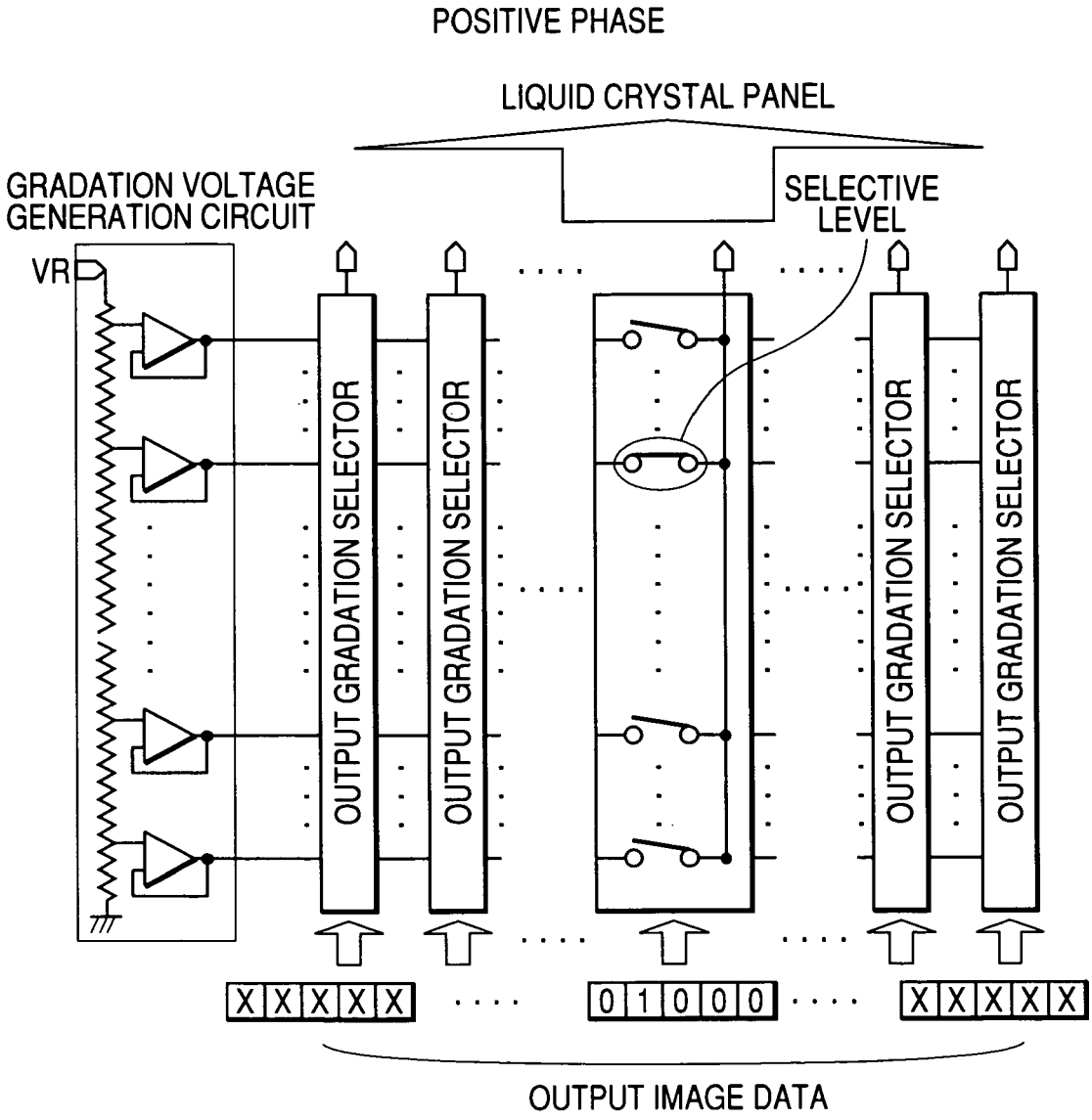
FIG. 2 is a block diagram showing an embodiment of an SEG driver according to the present invention corresponding to the positive phase.
Figure 3:
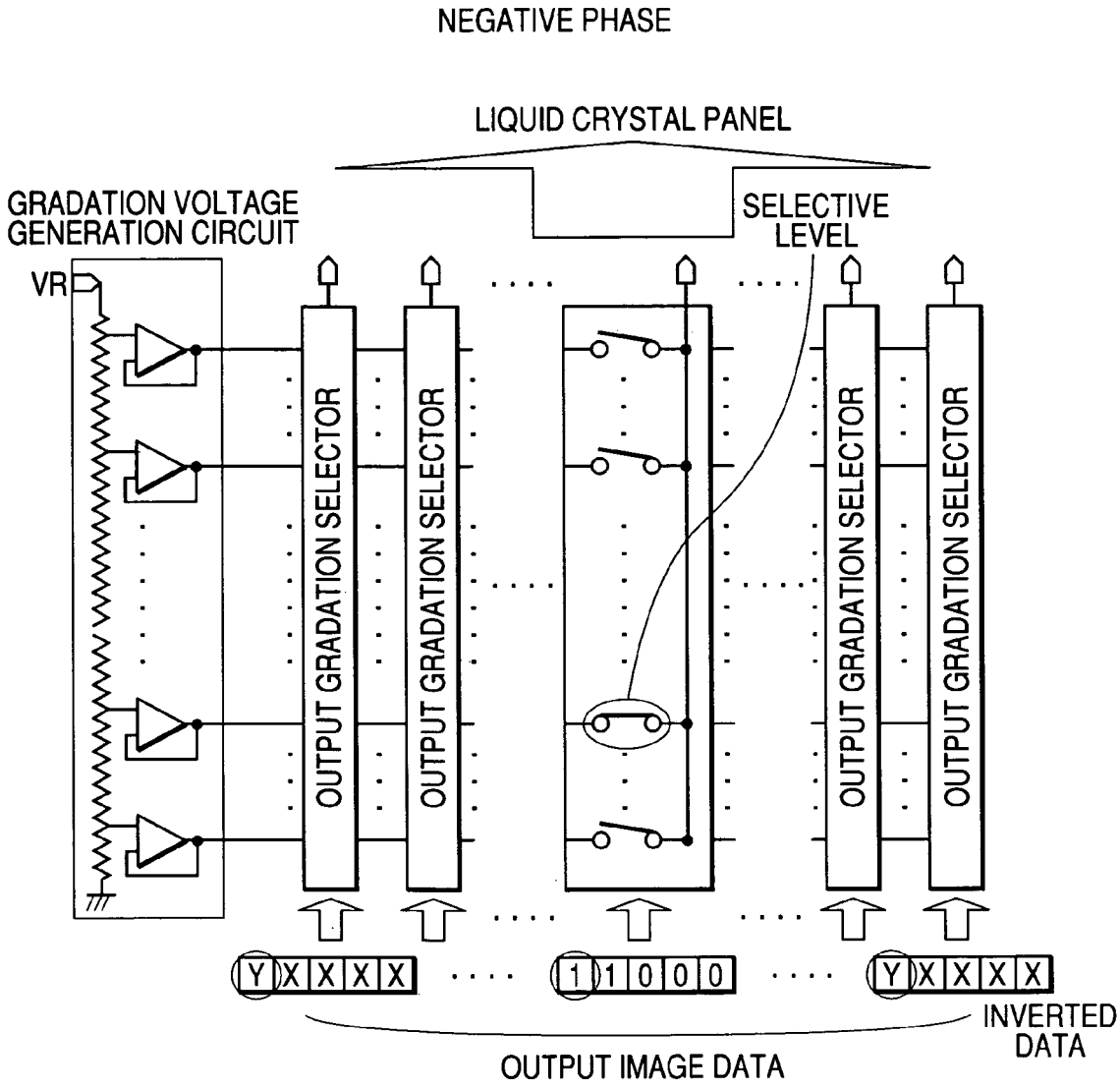
FIG. 3 is a block diagram showing an embodiment of the SEG driver according to the present invention corresponding to the negative phase.

FIGS. 2 and 3 show block diagrams of an embodiment of the SEG driver according to the present invention, in which FIG. 2 corresponds to the positive phase (first phase), and FIG. 3 corresponds to the negative phase (second phase). In FIGS. 2 and 3, a gradation voltage generation circuit divides a voltage VR for generating a gradation voltage formed by the booster circuit by a serial resistor circuit. When performing 32-gradation display, 32 gradation voltages V0 to V31 corresponding to the respective gradations 0 to 31 are formed. The gradation voltages are shared and supplied to a plurality of output gradation selectors provided corresponding respectively to a plurality of signal lines of the liquid crystal panel.

There are two liquid crystal alternating current drive methods including "line alternating current drive method" replacing the positive phase and the negative phase for each scanning line, and "frame alternating current drive method" replacing the positive phase and the negative phase once after drawing one screen. The frame alternating current drive method has contrast of pixels lower than that of the line alternating current drive method, resulting in deterioration of the image quality. In this point, the line alternating current drive method is superior. This embodiment employs the line alternating current drive method.

One of the gradation selectors representatively illustrated has switches selecting the plurality of gradation voltages. The switch at the selective level corresponding to output image data is brought to the on state to select one of the plurality of gradation voltages for outputting the gradation voltage supplied to the signal line of the liquid crystal panel from the shared couple node of the switch.

In this embodiment, in the positive phase and the negative phase, the bit conversion circuit as shown in FIGS. 4 and 5 makes only the highest order bit of output image data different. For the following reason, there are selected the gradation voltage selected in the positive phase and the gradation voltage selected in the negative phase with reference to a common voltage supplied to a common electrode of a liquid crystal so that when display data stored in the display RAM in adjacent pixels in the direction vertical to the gate line direction are the same, the two gradation voltages are opposite in polarity and have the same magnitude in the pixel electrodes.

Figure 16:
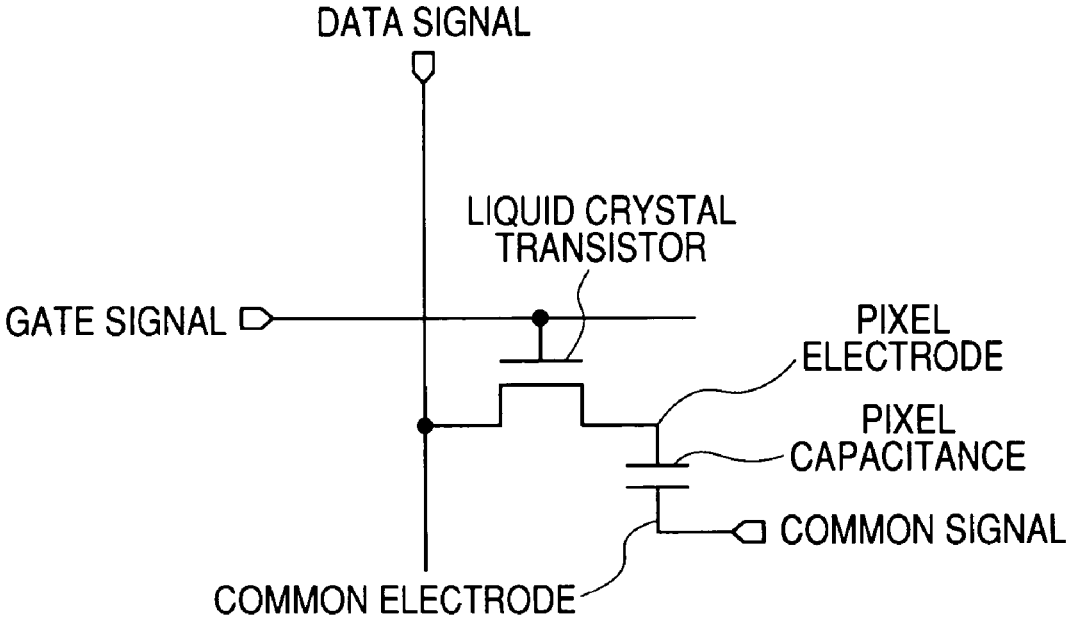
FIG. 16 is a block diagram showing an embodiment of a schematic diagram of a liquid crystal pixel in a liquid crystal panel according to the present invention.

As shown in FIG. 16, a pixel electrode device has a transistor whose gate is coupled to the gate line and performing control of whether a gradation voltage is inputted to a capacitor having a pixel capacitance for applying a voltage to a liquid crystal pixel by a gate signal, and a capacitor of the pixel device holding a voltage for driving the liquid crystal panel based on a common voltage and gradation voltages. Since the drive voltage amplitude (e.g., −10 to 15V) of the gate line is large, getting electric charges in and out is performed in the load capacitance of the transistor at the drive of the gate. Since the load capacitance of the transistor is serial-coupled to the capacitor of the pixel device, the capacitor of the pixel device cannot ignore the electric charge variation of the capacitor of the pixel device due to getting electric charges in and out in the load capacitance of the transistor at the drive of the gate. In order that the voltage magnitudes in pixel polarity can be the same, the gradation voltage selected in the positive phase and the gradation voltage selected in the negative phase are set in consideration of coupling drop (transfer voltage) due to voltage accumulated in the load capacitance of the MOS when the gate signal in the pixel device is off.

FIGS. 4 and 5 show schematic circuit diagrams of an embodiment of the SEG driver including the bit conversion circuit according to the present invention, in which FIG. 4 corresponds to the positive phase, and FIG. 5 corresponds to the negative phase. This embodiment corresponds to the case of performing 32-gradation display as above in which display data has 5 bits. Not being particularly limited, the display memory RAM for writing and reading display data is included in the TFT liquid crystal controller LSI of FIG. 1. The highest order bit of the display data read from the display memory RAM is supplied to exclusive logic circuit EOR 1 and the remaining 4 bits are supplied to exclusive logic circuits ENR 1 to 4. In FIGS. 4 and 5, it is assumed that in data outputted from the bit conversion circuit, the display data stored in the display RAM in adjacent pixels in the direction vertical to the gate line direction is the same. The display data inputted to the bit conversion circuit may be different.

Not being particularly limited, in the exclusive logic circuit EOR 1, a positive-negative switch signal is supplied to the other input thereof from the controller in synchronization with the switch between the positive phase and the negative phase, the highest order bit is outputted as it is when the positive-negative switch signal is logic 0 ("0") as in the positive phase of FIG. 4, and the highest order bit is inverted and outputted when the positive-negative switch signal is logic 1 ("1") as in the negative phase of FIG. 5. In the exclusive logic circuits ENR 1 to 4, the display data having the highest order bit is supplied to the other input thereof, as shown in FIGS. 4 and 5, the bits of the respective display data are outputted as they are when the signal of the highest order bit is logic 1 ("1"). Although not shown, the bits of the respective display data are inverted and outputted when the signal of the highest order bit is logic 0 ("0").

The exclusive logic circuit EOR 1 corresponding to the highest order bit of the display data outputs logic 0 when two inputs are matched with each other at logic 0 ("0") or logic 1 ("1"), and outputs logic 1 when two inputs are not matched with each other at logic 1 ("0") and logic 0 ("1"). The exclusive logic circuits ENR 1 to 4 corresponding to the low-order 4 bits of the display data output logic 1 ("1") when two inputs are matched with each other at logic 0 ("0") or logic 1 ("1"), and output logic 0 when two inputs are not matched with each other at logic 1 ("0") and logic 0 ("1").

The bit conversion circuit as such display data conversion circuit is used so that display data in which the gradation 31 is the least binary value of 00000 and the gradation 0 is the largest binary value 11111 are converted, as shown in the diagram of the relation between gradations and display data of FIG. 6. In the positive phase, the low-order 4 bits are not inverted from the gradations 15 to 0 in which the highest order bit is logic 1. The binary values of 10000 to 11111 are sequentially changed corresponding to the original display data. The low-order 4 bits are inverted by the logic 0 of the highest order bit from the gradations 31 to 16 in which the highest order bit is logic 0. The binary values of 00000 to 01111 are sequentially changed and incremented from the gradations 16 to 31. The pattern of the low-order 4 bits of the display data converted from the gradations 0 to 15 and the gradations 16 to 31 of the 32 gradations is symmetric up and down.

In the negative phase, only the highest order bit is changed when the positive-negative switch signal is logic 1. In the positive phase and the negative phase, only the highest order bit is different and the remaining low-order 4 bits are in the same bit pattern in the positive phase and the negative phase. In the case of the same data in the positive phase and the negative phase, the hamming distance between the converted data is 1.

In FIG. 4, as shown in the drawing, when display data is "1", "0", "0", "1" and "1", the display data conversion circuit outputs, in the positive phase, the display data "1", "0", "0", "1" and "1" as it is. The decoder forms a select signal selecting the gradation voltage V12 corresponding to 10011 from FIG. 6. The gradation voltage V12 is a liquid crystal output from the gradation selector.

In FIG. 5, when the display data is "1", "0", "0", "1" and "1", the positive-negative switch signal is logic 1 in the negative phase. The display data conversion circuit converts the display data to be "0", "0", "0", "1" and "1" for output. The decoder forms a select signal selecting the gradation voltage V19 corresponding to 00011 from FIG. 6. The gradation voltage V19 is a liquid crystal output from the gradation selector. When the display data is "1", "0", "0", "1" and "1", the gradation voltages V12 and V19 are applied in the positive phase and the negative phase to the liquid crystal. The voltages opposite in polarity with reference to a common voltage and having the same magnitude in the pixel electrodes can be supplied.

Figure 7:
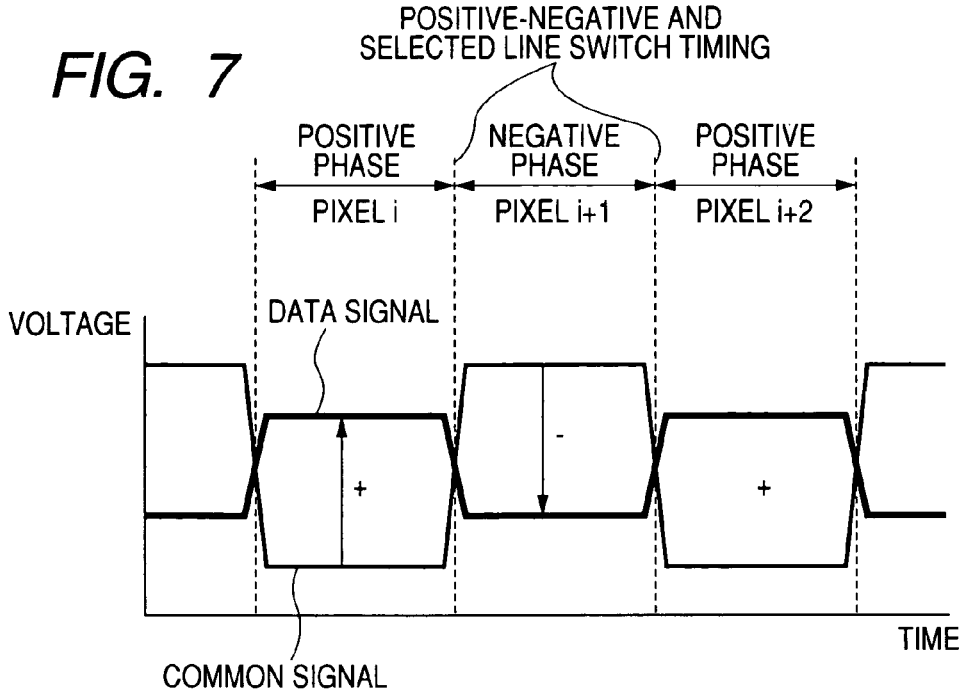
FIG. 7 is a waveform diagram showing an example of voltages added to a liquid crystal according to the present invention.
Figure 8:
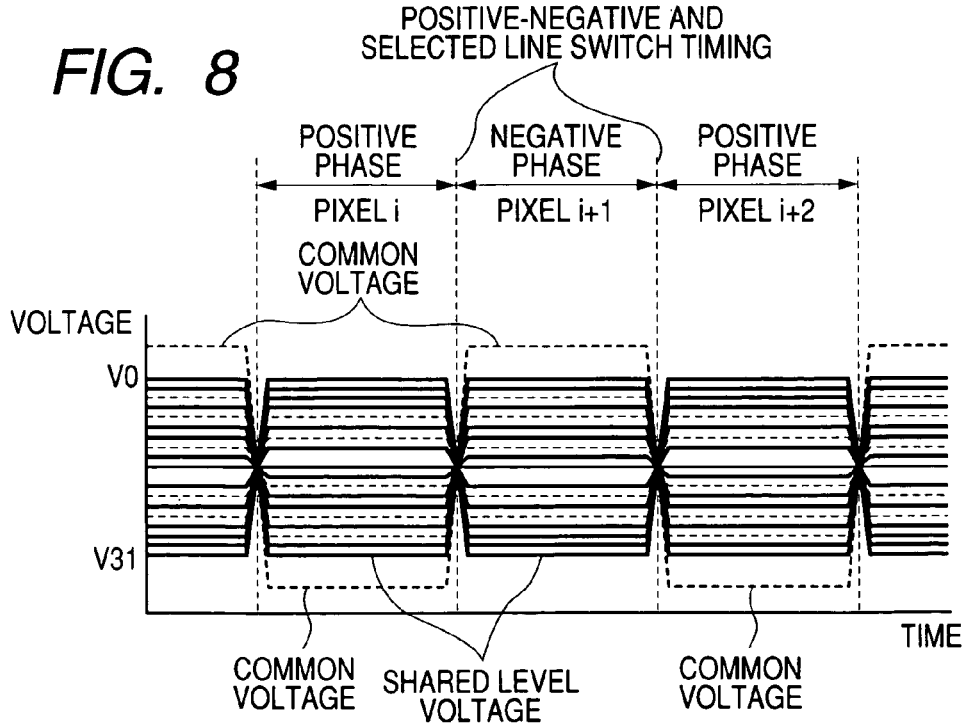
FIG. 8 is a voltage waveform diagram of assistance in explaining the relation between the gradation voltage and the common voltage used for the present invention.

FIGS. 7 and 8 show voltage waveform diagrams added to the liquid crystal. In the positive phase, a common voltage is lower than the lowest voltage (the gradation 31) of 32 gradation voltages. The pixels i, i+1 and i+2 are adjacent pixels in the direction vertical to the gate line direction. When the gradation voltage V12 is selected from the gradation voltages V31 to V0 corresponding to the display data in the pixel i, a positive gradation voltage is applied to the liquid crystal pixel.

In the negative phase, a common voltage is higher than the highest voltage (the gradation 0) of 32 gradation voltages. When the gradation voltage V19 is selected from the gradation voltages V31 to V0 corresponding to the display data in the pixel i+1, a negative gradation voltage is applied to the liquid crystal pixel. The voltage difference between the gradation voltage V12 and the common voltage and the voltage difference between the gradation voltage V19 and the common voltage provide voltages opposite in polarity and having the same magnitude in the pixel electrodes, as described above. In FIGS. 7 and 8, it is assumed that in data outputted from the bit conversion circuit, display data stored in the display RAM in adjacent pixels in the direction vertical to the gate line direction is the same. The display data stored in the display RAM in adjacent pixels in the direction vertical to the gate line direction may be different.

Figure 9:
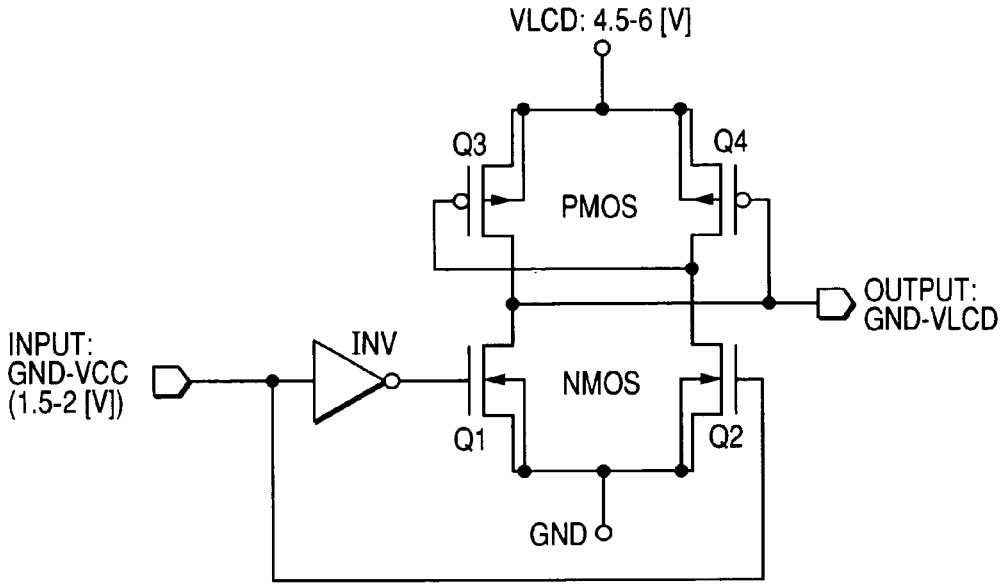
FIG. 9 is a circuit diagram showing an embodiment of a level shift circuit used for the present invention.

To output the gradation voltages V31 to V0, a voltage higher than a threshold voltage rather than the highest voltage V0 must be supplied to the gate of the MOSFET constructing a switch of FIGS. 4 and 5. The selective level of the select signal of the switch must be a relatively high voltage. To form such a select signal, a level shifter circuit as shown in FIG. 9 is used. The level shifter circuit level-shifts a logic signal of about 1.5 to 2V to 4.5 to 6V corresponding to the selective level.

The level shifter circuit has N-channel MOSFET Q1 and Q2 provided on the ground potential side of the circuit, P-channel MOSFET Q3 and Q4 provided on the high voltage VLCD side, and inverter circuit INV. The P-channel MOSFET Q3 and Q4 are in a latch form so that their gates and drains are cross-coupled. The drains of the N-channel MOSFET Q1 and Q2 are coupled respectively to the drains of the P-channel MOSFET Q3 and Q4. An input signal is inputted to the gate of the MOSFET Q2. An input signal inverted by the inverter circuit INV is supplied to the gate of the MOSFET Q1. An output signal is formed from the shared and coupled drain of the MOSFET Q1 and Q3.

When the input signal is at low level, the N-channel MOSFET Q2 is in the off state and the output signal of the inverter circuit INV is at high level. The N-channel MOSFET Q1 is thus in the on state. The on state of the MOSFET Q1 brings the P-channel MOSFET Q4 to the on state. The off state of the N-channel MOSFET Q2 brings the gate voltage of the P-channel MOSFET Q3 to the voltage VLCD. The P-channel MOSFET Q3 is thus in the off state. An output signal is at low level like the ground potential of the circuit corresponding to the on state of the MOSFET Q1.

When the input signal is changed from low level to high level, the N-channel MOSFET Q2 is in the on state so that the N-channel MOSFET Q1 is in the off state. The on state of the N-channel MOSFET Q2 draws out the gate potential of the P-channel MOSFET Q3 to the low level side to bring the MOSFET Q3 to the on state. The on state of the MOSFET Q3 charges up the gate voltage of the MOSFET Q4 to the voltage VLCD to bring the P-channel MOSFET Q4 to the off state. An output signal is at high level like the VLCD corresponding to the on state of the P-channel MOSFET Q3. A low-amplitude signal of 1.5 to 2.0 [V] is level-shifted to an output voltage of 4.5 to 6.0 [V].

Figure 10:
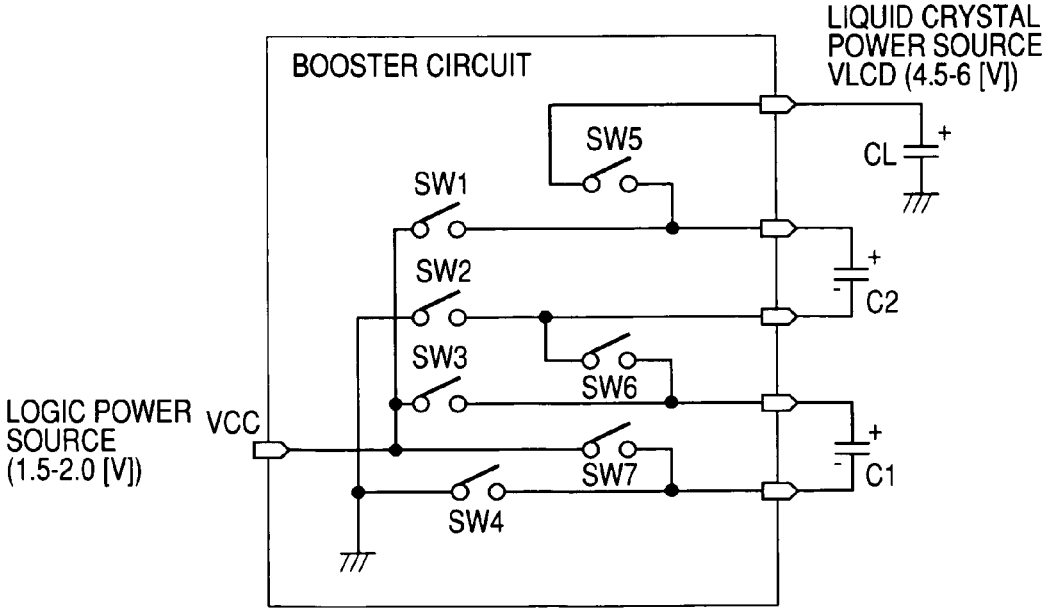
FIG. 10 is a circuit diagram showing an embodiment of a booster circuit of FIG. 1.
Figure 11:
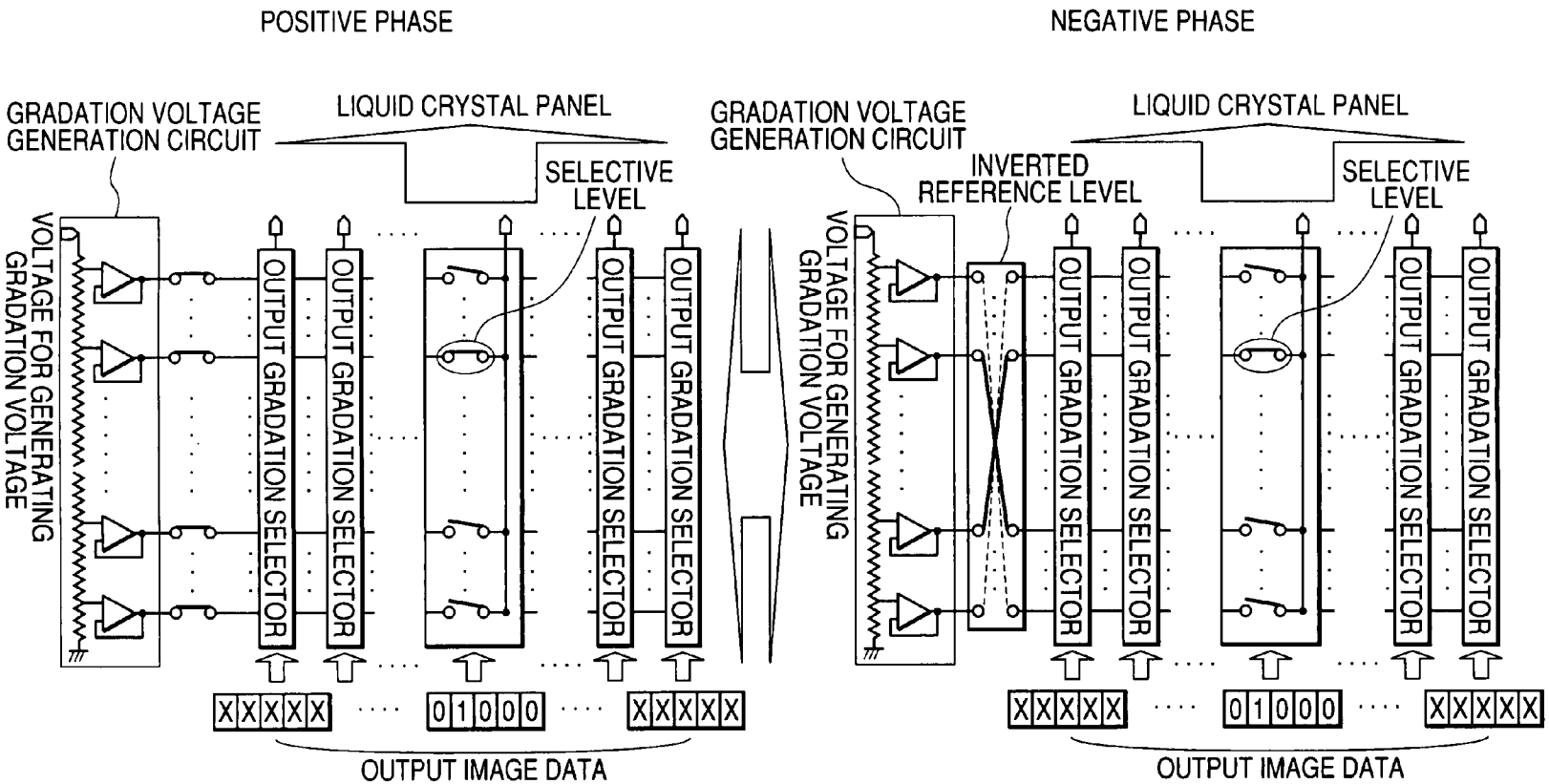
FIG. 11 is an alternating current drive explanatory view of liquid crystal voltages by a dynamic switch method which has been studied prior to the present invention.

FIG. 10 shows a circuit diagram of an embodiment of the booster circuit of FIG. 1. A clock (pulse signal) not shown, alternately switches switches SW 1, 2, 3 and 4 and SW 5, 6 and 7 between the on and off states. Capacitors C1, C2 for booster circuit are coupled in parallel with a boost reference power source of about 1.5 to 2V, e.g., operation voltage VCC of the logic circuit and are charged. They are switched to serial couple to charge up capacitance CL for output voltage by the boosted voltage for constructing a charge pump circuit forming the output voltage VLCD about three times the reference voltage VCC.

When the boosting clock is at high level, as shown in the drawing, the switches SW 1, 2, 3 and 4 are brought to the on state. When the SW 5, 6 and 7 are brought to the off state by the low level of the inverted boosting clock, the switches SW 1 and 3 supply the boost reference voltage VCC to the + electrodes of the capacitors C1 and C2. The switches SW 2 and 4 give the ground potential of the circuit to the − electrodes of the capacitors C1 and C2. The capacitors C1 and C2 are charged up to the boost reference voltage VCC.

When the boosting clock is changed from high level to low level, the switches SW 1, 2, 3 and 4 are switched to the off state and the switches SW 5, 6 and 7 are switched to the on state. The boost reference voltage VCC is given to the − electrode of the capacitor 1 by the on state of the switch SW 7. The capacitors C1 and C2 are coupled in a serial form by the on state of the switches SW 6 and 5. The triple boost voltage is outputted from the switch SW 5 to be transmitted to the capacitor CL. This is repeated in the same manner so that the output voltage VLCD is a boost voltage up to three times the boost reference voltage VCC. When requiring a higher voltage, it is boosted to be twice the boost voltage. Alternatively, when requiring a negative voltage below the ground potential of the circuit, a voltage in negative polarity can be formed from the triple boost voltage.

Figure 15:
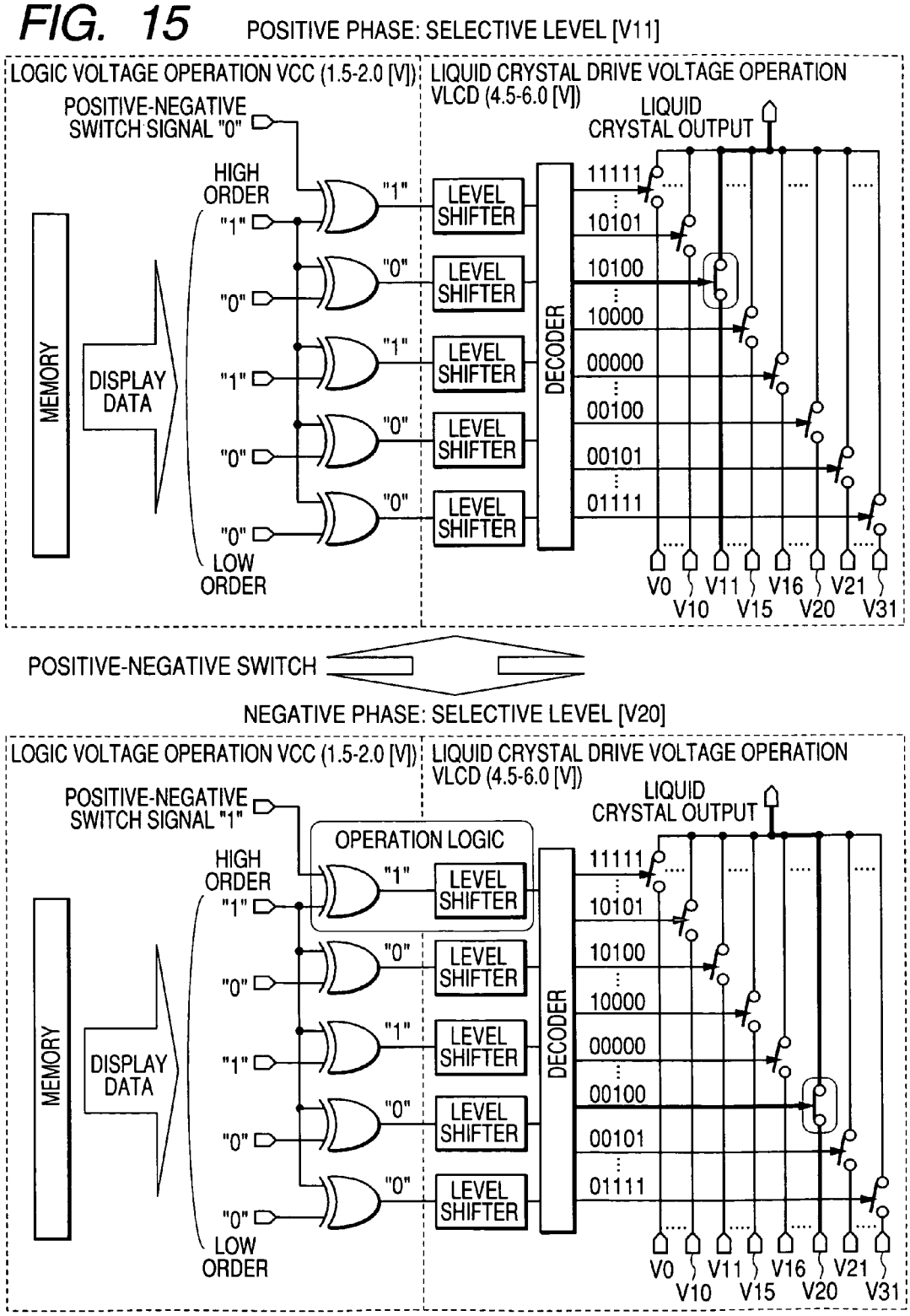
FIG. 15 is a block diagram showing an embodiment of an alternating current drive circuit of a liquid crystal voltage by the control bit switch method according to the present invention.

At the positive-negative switch of the liquid crystal output as shown in FIGS. 12 and 13, all or most logics and level shifter circuits shifting the voltage level from a logic voltage to a liquid crystal voltage are operated to all the bits. In this embodiment, as shown in FIG. 15, only the highest order bit is changed. The number of logics constructing decoders operated and level shifter circuits shifting the voltage level from a logic voltage to a liquid crystal voltage is 1/gradation bits (1 divided by gradation bits) as compared with the construction of FIGS. 12 and 13 when the gradation data of adjacent pixels are the same.

The liquid crystal voltage VLCD used in the level shifter circuit is a voltage generated by boosting the logic voltage VCC by the booster circuit. As the number of operation circuits is smaller, the power consumption of the entire chip can be lowered by a boost multiplying factor of the logic voltage. The present invention can reduce the amount of change in display data in the positive phase and the negative phase at alternating current drive. As the display frequency and the number of outputs are increased, the power consumption can be lowered. The display data bit allocation method according to the present invention can be applied regardless of the number of gradation bits. The effect can be increased as the number of gradation bits is increased.

For example, the example of the LSI is such that the number of signal lines of the liquid crystal panel is 720 with display data of 5 bits corresponding to the 32-gradation display. In the construction of FIGS. 12 and 13, signals for nearly 720×5=3600 circuits are changed at the switch between the positive phase and the negative phase. In the present invention, signals for about 720×1=720 circuits are changed at the switch between the positive phase and the negative phase so that the power consumption can be significantly lowered to ⅕. The CMOS circuit performs charge/discharge of the load capacitance by the change of signals to produce a consumed current. The reduction of the number of operation circuits can significantly lower the power consumption.

When the decoder circuit decodes the level-shifted display data, the number of operations of the level shifter circuit flowing a relatively large consumed current is tremendous as described above. A construction forming an operation voltage by the charge pump circuit significantly increases the consumed current in the charge pump circuit itself to make the power consumption larger. The present invention is applied to significantly reduce an electric current consumed by the circuit operations to about 1/gradation bits (1 divided by gradation bits).

The above-described construction decoding level-shifted display data for output requires five level shifter circuits per gradation selector. The construction level-shifting the output of the decoder circuit requires 32 level shifter circuits corresponding to 32 gradations. The level shifter circuit must form the size of the MOSFET used for performing the level shift operation fast to be large, requiring an occupation area about 10 to 15 times the gate circuit constructing the decoder. The above-described construction supplying level-shifted display data to the decoder is advantageous to reduce the occupation area.

The present invention which has been made by the present inventors is specifically described above based on the embodiments. The present invention is not limited to the embodiments and various modifications can be made in the scope without departing from its purpose. For example, the data conversion construction changing only one specified bit of display data in the positive phase and the negative phase may use the highest order bit as in the embodiments, and so on.

In FIG. 6, display data in binary can be converted most easily. In the positive phase and the negative phase in the drawing, when the highest order bit is replaced with any one of low-order 4 bits to decode the respective bit patterns by the decoder, the same effect can be obtained. The data conversion circuit may include a circuit performing such bit replacement. The present invention can be widely used as the liquid crystal drive method and the liquid crystal display device used for a portable phone and a portable small electronic terminal operated by a battery. The present invention is also effective for the positive-negative switch method for each scanning line selection. When it is applied to the frame alternating current drive method, no problems occur since display data is not changed at all. The application of the present invention can optimally apply the line alternating current drive method and the frame alternating current drive method by a simple construction to lower the power consumption in the line alternating current drive method.

The effects obtained by the representative inventions disclosed in the present invention will be briefly described as follows. A common voltage given to a common electrode of a liquid crystal is switched between the positive phase and the negative phase corresponding to display data in display memory. Display data is converted in such a manner that first display data and second display data selecting two of a plurality of gradation voltages in which the magnitudes of the potential differences in the pixel electrodes in the positive phase and the negative phase with reference to the common voltage are the same are in the same bit pattern except for one specified bit. For example, bit allocation of positive and negative gradation display data is made in such a manner that low-order bits other than the highest order bit are symmetric up and down with respect to the middle and that the highest order bit is an up-and-down allocation bit.

Without changing the existing software and the existing gradation data allocation, the bit conversion circuit of the present invention is provided in the LCD driver. It is possible to provide the LCD driver which can secure compatibility and can perform the gradation voltage selector operation at the change from the positive phase to the negative phase or the change from the negative phase to the positive phase at alternating current drive by a low power consumption.

When using the LCD driver of the present invention in the case of system change so as to use the existing liquid crystal display system and software as they are and to replace only the LCD driver, the gradation voltage selector operation at the change from the positive phase to the negative phase or the change from the negative phase to the positive phase at alternating current drive can be performed by a low power consumption. In addition, the bit order and allocation of the respective gradation data of RGB corresponding to each pixel stored in the incorporated memory of the LCD driver by the CPU are the same as the prior art. It is thus possible to provide the liquid crystal display system which can display a color to be displayed in the color intended for the liquid crystal panel.

What is claimed is:

1. A method for driving a plurality of pixels in a display panel by a display driver in accordance with a positive phase and a negative phase of a display mode, the method comprising:

inputting display data to a first driver in the display driver;

converting the display data into first display data in the positive phase and into second display data in the negative phase using a converting circuit in the display driver in response to a switching signal, which is different from the display data, and which switches between the positive phase and the negative phase, the converting of the display data being performed such that a highest order bit of the display data is set to logic "0" by a first exclusive logic circuit when the switching signal and the highest order bit match each other and is set to logic "1" by the first exclusive logic circuit when the switching signal and the highest order bit do not match each other, and such that each remaining lower order bit of the display data is set to logic "1" by an associated second exclusive logic circuit of a plurality of second exclusive logic circuits when the highest order bit matches the remaining lower order bit and set to logic "0" by the associated second exclusive logic circuit when the highest order bit does not match the remaining lower order bit, whereby the first display data and the second display data are in the same bit pattern except for the highest order bit when converting the display data;

generating a plurality of gradation voltages using a gradation voltage generating circuit in the display driver;

generating a first common voltage in the positive phase and a second common voltage, different from the first common voltage, in the negative phase using a common voltage driver in the display driver, wherein the first and the second common voltage is applied to a common electrode of the plurality of pixels in the display panel;

selecting, using a selector in the display driver, a first gradation voltage from the plurality of gradation voltages based on the first display data in the positive phase and a second gradation voltage from the plurality of gradation voltages based on the second display data in the negative phase, wherein the first gradation voltage and the second gradation voltage are applied to a pixel electrode of a selected pixel of the plurality of pixels in the display panel;

in the positive phase, providing the first gradation voltage and the first common voltage to the display panel; and in the negative phase, providing the second gradation voltage and the second common voltage to the display panel.

2. A method according to claim 1, wherein the display driver further comprises a RAM, and wherein, in said inputting, the display data is provided from the RAM to the first driver.

3. A method according to claim 1, wherein, in said inputting, the display data is provided from a microcomputer.

4. A display system comprising:

a display panel including a plurality of signal lines, a plurality of scanning lines, a common electrode, a plurality of pixels coupled to the plurality of signal lines, the plurality of scanning lines, and the common electrode so that one pixel is coupled to one signal line, one scanning line, and the common electrode, wherein one pixel includes a MOSFET having a gate coupled to one scanning line and a source-drain path coupled between one signal line and a pixel electrode opposite to the common electrode;

a display driver coupled to the plurality of signal lines, the plurality of scanning lines, and the common electrode, wherein the display driver comprises:

a gradation voltage generator providing a plurality of gradation voltages;

a first driver coupled to the plurality of signal lines and including:

a converting circuit coupled to receive display data and a switching signal, different from the display data, which controls a switching of a positive phase and a negative phase, and which provides first data in the positive phase and second data in the negative phase based on the display data, such that a highest order bit of the display data is set to logic "0" by a first exclusive logic circuit when the switching signal and the highest order bit match each other and is set to logic "1"by the first exclusive logic circuit when the switching signal and the highest order bit do not match each other, and such that each remaining lower order bit of the display data is set to logic "1" by an associated second exclusive logic circuit of a plurality of second exclusive logic circuits when the highest order bit matches the remaining lower order bit and set to logic "0" by the associated second exclusive logic circuit when the highest order bit does not match the remaining lower order bit, whereby the first data and the second data are in the same bit pattern except for the highest order bit when converting the display data, and selectors coupled to receive the plurality of gradation voltages and to select ones of the plurality of gradation voltages for the plurality of signal lines, respectively, in response to the first data and the second data;

a second driver coupled to the plurality of scanning lines and which outputs a selection signal to sequentially select one of the plurality of scanning lines; and a third driver coupled to the common electrode and which provides, to the common electrode, a first common voltage in the positive phase and which provides, to the common electrode, a second common voltage different from the first common voltage in the negative phase.

5. A display system according to claim 4, wherein the display driver further comprises a display memory which provides the display data.

6. A display system according to claim 5, wherein the display driver is on a semiconductor substrate.

7. A display system according to claim 4, wherein the display driver is on a semiconductor substrate.

8. A display system according to claim 4, further comprising a microcomputer which provides the display data.

9. A display driver on a semiconductor substrate and for use with a display panel including a plurality of signal lines, a plurality of scanning lines, a common electrode, a plurality of pixels coupled to the plurality of signal lines, the plurality of scanning lines, and the common electrode so that one pixel is coupled to one signal line, one scanning line, and the common electrode, wherein one pixel includes a MOSFET having a gate coupled to one scanning line and a source-drain path coupled between one signal line and a pixel electrode opposite to the common electrode, and wherein the display driver is coupled to the plurality of signal lines, the plurality of scanning lines, and the common electrode, the display driver comprising:

a gradation voltage generator which provides a plurality of gradation voltages;

a display memory which stores display data;

a first driver to be coupled to the plurality of signal lines and including:

a converting circuit coupled to receive the display data, and which is responsive to a switching signal, which is different from the display data, that controls a switching of a positive phase and a negative phase, and which provides first data in the positive phase and second data in the negative phase, such that a highest order bit of the display data is set to logic "0" by a first exclusive logic circuit when the switching signal and the highest order bit match each other and is set to logic "1" by the first exclusive logic circuit when the switching signal and the highest order bit do not match each other, and such that each remaining lower order of the display data is set to logic "1" by an associated second exclusive logic circuit of a plurality of second exclusive logic circuits when the highest order bit matches the remaining lower order bit and set to logic "0" by the associated second exclusive logic circuit when the highest order bit does not match the remaining lower order bit, whereby the first data and the second data are in the same bit pattern except for the highest order bit when converting the display data, and selectors coupled to receive the plurality of gradation voltages, and which select ones of the plurality of gradation voltages for the plurality of signal lines, respectively, in response to the first data and the second data;

a second driver coupled to the plurality of scanning lines, and which outputs a selection signal to sequentially select one of the plurality of scanning lines; and a third driver coupled to the common electrode, and which is provides to the common electrode a first common voltage in the positive phase and which provides to the common electrode a second common voltage different from the first common voltage in the negative phase.

* * * * *